United States Patent [19]

Wehrli

[11] 4,249,752

[45] Feb. 10, 1981

[54] BRAKE FOR A SKI WITH A SAFETY-BINDING

[76] Inventor: Hans Wehrli, Zürcherstrasse 81, Rapperswil, Switzerland

[21] Appl. No.: 5,796

[22] Filed: Jan. 23, 1979

[30] Foreign Application Priority Data

Jan. 31, 1978 [CH] Switzerland ..... 1013/78

[51] Int. Cl.[3] ..... A63C 5/00

[52] U.S. Cl. ..... 280/605

[58] Field of Search ..... 280/605, 604; 188/5, 188/6, 8; 267/158

[56] References Cited

U.S. PATENT DOCUMENTS

| | | | |
|---|---|---|---|
| 3,924,864 | 12/1975 | Weigl | 280/605 |
| 3,930,659 | 1/1976 | Salomon | 280/605 |
| 3,964,760 | 6/1976 | Riedel | 280/605 |
| 4,138,137 | 2/1979 | Beyl | 280/605 |

FOREIGN PATENT DOCUMENTS

| | | | |
|---|---|---|---|
| 2632892 | 1/1978 | Fed. Rep. of Germany | 280/60 |

*Primary Examiner*—Robert J. Spar
*Assistant Examiner*—Kenneth Noland
*Attorney, Agent, or Firm*—Roylance, Abrams, Berdo & Farley

[57] ABSTRACT

The brake is of the type in which a spring wire bale is held down against the ski by a ski-boot inserted into the ski-binding. The bale pivots at the rear of the binding and from there extends into brake spurs which, when the bale is held down, extend above, and parallel to the ski. When the bale is released, it pivots the brake spurs down into the snow to stop the ski. The spring action is provided by spiral springs which pass from the brake arms of the bale over a cam surface of a trunnion and then again to the brake arms where the brake spurs begin. An adjustable device for fixing the trunnions to the ski with shanks are described. Special contouring of the cam surface and corresponding curvature of that part of the brake arm which pivots on the cam surface permits the spurs to be raised above the upper ski surface when the bale is down. Detents in the shanks permit the spurs to also be moved inwardly in this position. Alternative structures for the trunnions and also for the use of a leaf spring in place of the spiral spring are described.

18 Claims, 5 Drawing Figures

Fig. 3
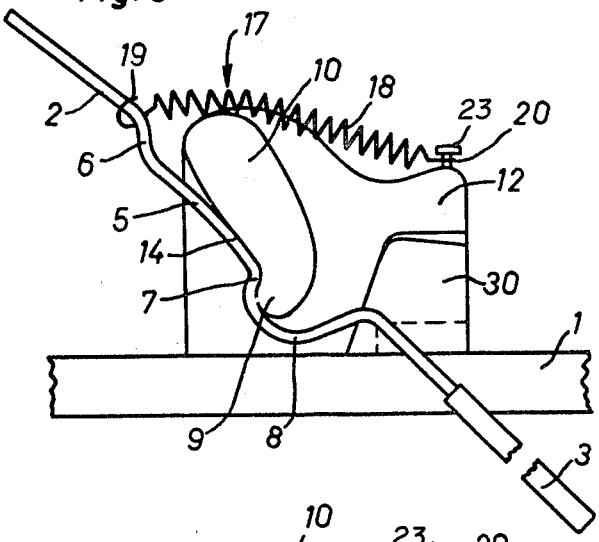
Fig. 4
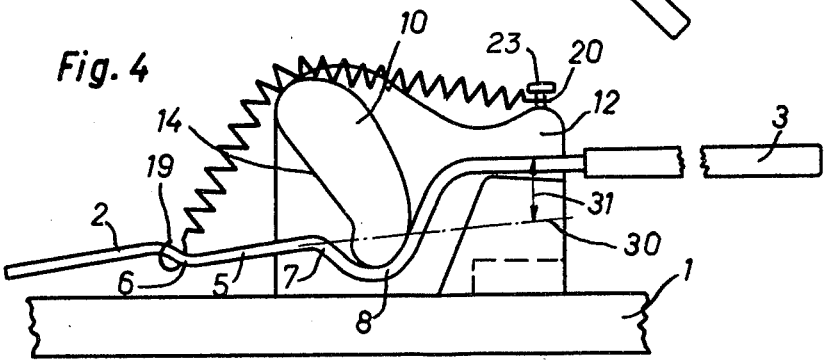
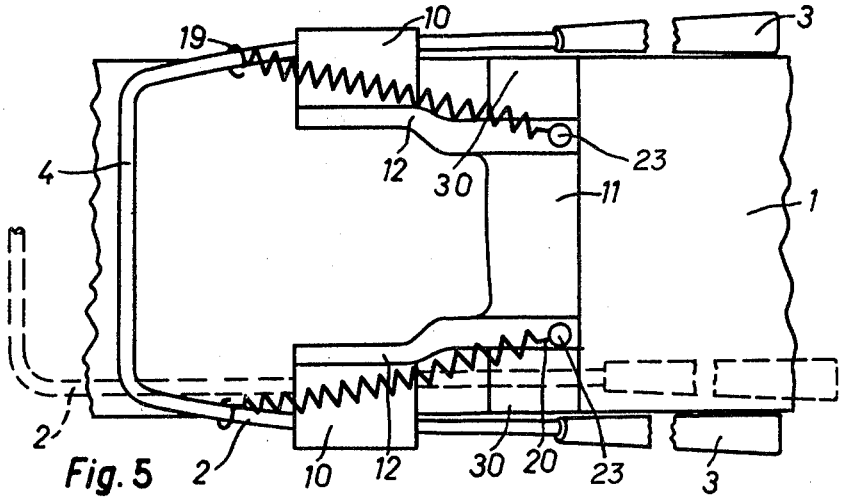
Fig. 5

BRAKE FOR A SKI WITH A SAFETY-BINDING

BACKGROUND OF THE INVENTION

Ski-brakes with a pivotable brake arm are known in many forms. They are relatively simple in their construction and consist essentially of a wire bale attached to two brake spurs. The bale is pivotably supported on the upper side of the ski by trunnions. A spring element is so provided that when the ski-boot is removed from the ski-binding, the bale leaves its rest position, swings with the brake spurs into the braking position, and is held there with sufficient force to perform its braking function.

The known ski-brakes of this form have the disadvantage that in the rest position a relatively strong force is exerted by the spring on the bale, and therefore on the sole of the ski-boot, while in the braking position the holding force of the spring element is usually just barely sufficient. If it is desired to decrease the difference in the spring force in the rest position and the holding force in the brake position, then such ski-brakes require additional elements which increase their manufacturing cost.

It is an object of the present invention to provide a ski brake for which the difference between the spring force in the rest position and the holding force in the braking position can be chosen as desired, while at the same time leaving sufficient holding force in the braking position, and to do so with a minimum of structural elements without thereby complicating further the construction of the ski-brake.

SUMMARY OF THE INVENTION

A novel ski-brake in accordance with the present invention has a brake arm which is pivotably supported on a guide cam between the brake arm and the spring element, at least one end of the spring element being connected with the brake arm.

BRIEF DESCRIPTION OF THE DRAWINGS

FIG. 3 is a side view of a fragment of a ski with a ski-binding. A ski-brake in accordance with a second embodiment of the present invention is mounted on it and in the braking position.

FIG. 4 is a side view of the apparatus of FIG. 3, with the ski-brake in the rest or skiing position.

FIG. 5 is a top view of the apparatus of FIG. 3.

DESCRIPTION OF THE PREFERRED EMBODIMENTS

Figure 1:
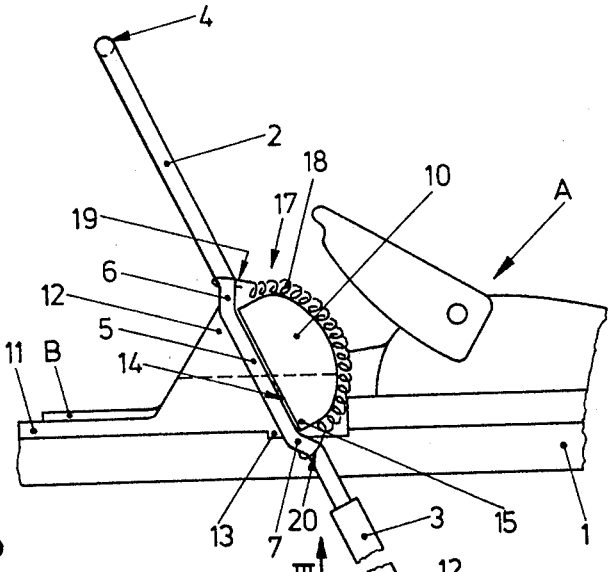
FIG. 1 is a side view of a fragment of a ski with a ski-binding. A ski-brake in accordance with a preferred embodiment of the present invention is mounted on it and in the braking position.

In the Figures, there is partially shown a ski 1 which has fastened to its upper side a part A of a safety-binding, such as a heel release mechanism. Between the part A and a further, not shown part of the safety-binding there is arranged a ski-brake. The brake has at least one brake arm 2 which at its one end has a brake spur 3 and at its other end has an actuating device. The actuating device may be, for example, a kick rod 4 extending over the upper side of the ski 1 and operated by the sole or heel of the ski-boot. The brake arm 2 has a mid-portion or contact portion 5 formed by bends 6, 7 and is displaced in relation to the other parts of the brake arm 2, which for the brake position shown in the FIG. 1 lies against a contact surface 14 of a trunnion in the form of a guide cam 10. Each brake arm 2 is swung into the position shown in FIG. 1 and held there with a certain tension by means of a spring element 17. In FIG. 1, the spring element 17 is constructed as a spiral spring 18 which passes part of the way around, that is about half the circumference, and with its hook-shaped ends 19, 20 is connected to the brake arm 2 at the bends 6, 7. It is nevertheless essential that the brake arm 2 is arranged on the one side of the guide cam 10, and the spring element 17 is arranged on the other side. That is, the guide cam 10 lies between the brake arm 2, or its mid-portion 5, and the spring element 17, which is itself connected with the brake arm 2 with at least one end.

The guide cam 10 is fastened to the upper side of the ski 1 by means of a base, which is made up of a base plate 11 and a support shank 12 connecting the guide cam 10 with the base plate 11. The guide cam 10 can be made of metallic or non-metallic material. A synthetic material, such as that known by the trade mark "DELRIN" for example, is also suitable.

Figure 2:
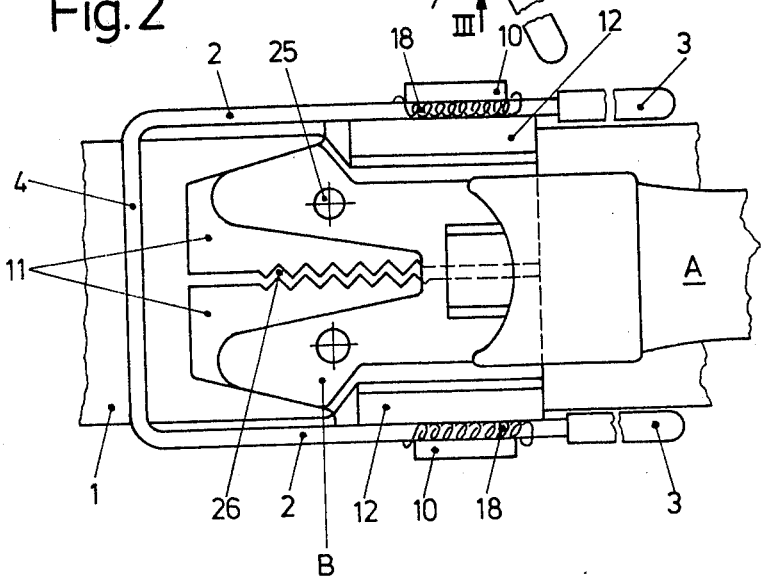
FIG. 2 is a top view of the apparatus of FIG. 1.

The ski brake shown in FIG. 2 has two of the brake arms 2 shown in FIG. 1, which are connected to each other by an actuating device formed by a kick rod 4. Each brake arm 2 has a guide cam 10, which is formed in the same manner as in the ski brake shown in the FIG. 1. In FIG. 2, the brake arms 2 are shown in the rest position. That is, as compared to the position shown in FIG. 1, they are swung into a position parallel to the upper surface of the ski 1. In this position, the brake arm 2 lies against a bearing portion 15 of the guide cam 10 directed toward the upper surface of the ski.

As can be seen from FIG. 2, a plate B connected to the part A can be used for connection of the base plates 11 of both guide cams 10. The base plates 11 each have a bore 25 which is aligned with a corresponding bore of the plate B and through which a not shown screw is inserted, by which the plate B and the base plates 11 are fastened to the upper side of the ski 1. In place of the plate B, there can also be used a separate cover plate to fasten the base plates 11 to the upper side of the ski 1. Since the base plates 11 each have only one bore 25, they can be pivoted about the axis of this bore 25. Thereby, it is possible to adapt the brake to different widths of the ski 1. In order to permit the brake to be pivoted without touching the ski 1, the guide cam must always be in the proper position relative to the upper longitudinal edge of the ski. The positions of the guide cams 10 can be held by stops 13 on the footplates 11 which extend beyond the longitudinal edge of the ski 1. The base plates 11 further have serrations 26 which permit their interlocking.

The ski brake shown in FIGS. 3–5 additionally permits the brake arms to be held so that it can be moved inwardly to bring them above the ski and away from the longitudinal edge of the ski, so that even by extreme tilting of the ski relative to the slope, any contact of the braking spurs with the snow surface is practically completely avoided.

In the FIGS. 3–5, there are used in part the same reference symbols as in FIGS. 1 and 2. Therefore, only the parts that are different will be described. The brake arm 2 is swung into its position and held there with a certain force by the spiral springs 18, as in the embodiment of FIGS. 1 and 2. While each of the spiral springs here also passes over the guide cam 10, nevertheless it grasps with the ends 19, 20 on the one side the bend 6 of the brake arm 2 and on the other side a hook 23 arranged on the support shank 12 (FIGS. 3 and 4). In this arrangement, the brake arm 2 and the spring 18 are also arranged on opposite sides of the guide cam 10. That is, the guide cam 10 lies between the brake arm 2, or its mid-portion 5, and the spring 18.

As can be seen from FIG. 5, there is involved here a ski brake with two brake arms which are connected with a kick rod 4 and form an actuating bale. The support shanks 12 with the guide cams 10 for the two brake arms 2 are connected with each other through the base plates 11 and attached to the upper side of the ski. Between the two support shanks 12 there can be arranged a part of a safety ski-binding, such as a heel release mechanism. On the portion of each of the guide cams 10 which is directed toward the ski 1, there is a supporting lobe which has the approximate shape of a half-round trunnion. In the region of the lower bend 7 of each brake arm 2, there is formed a supporting bow 8 which matches the curvature of the supporting lobe 9. By means of the supporting bow 8, there is defined a supporting position for the brake arm 2 on the guide cam 10. By means of the supporting lobe 9, there is additionally achieved that the portion of the brake arm 2 carrying the brake spur 3 is displaced upwards a certain distance 31 relative to the mid-portion 5. If the brake arm 2 is swung into the skiing position, which is approximately parallel to the ski 1, then the brake spur 3 lies higher over the upper surface of the ski 1 than the remaining brake arm 2 by about the distance 31. Thereby, it can as a practical matter no longer come into contact with the snow surface, even when the ski is strongly tilted to the snow surface.

The position of the two brake spurs 3 joined to the one bale (see FIG. 5) can be further influenced in that there is provided on each support shank 12 a detent 30 in the form of an indentation which begins at the longitudinal edge of the upper side of the ski 1 and extends upward and inward. The brake arms 2 lie against the detents 30. In the brake position, the brake spur 3 extends beyond the longitudinal edge of the ski 3, while in the skiing position, it can move inward into the position shown in broken lines, so that it no longer lies beside, but rather over the ski 1, by which it is brought even further outside the region of possible contact with the snow surface. In order to achieve this, the bale, which consists of the two brake arms 2 and the kick rod 4, is constructed with a smaller width than the width of the ski, and is sufficiently pulled apart that the brake arms lie under tension in the detents 30 and follow the detents in the course of the transition from the brake position to the ski position. Various configurations can be chosen for the shape of the detent 30, and it is suitable for it to have immediately in the vicinity of the upper side of the ski a flank which is vertical to the upper side of the ski. When, in the course of moving from the brake position to the skiing position, the brake spur 3 moves into the region of the ski 1, where the detent 30 has an inwardly curved surface. It can be seen from the FIG. 5, that then the guide cams 10 permit a sideways displacement of the brake arms 2 from the expanded position to the broken-line position at the support shank 12.

By matching the configuration of the support lobe 9 to the brake arm 2, the spacing 31 of the brake spurs 3 from the mid-portion 5 of the brake arm 2 is determined. The spacing 31 can nevertheless be chosen to be greater, and this can be achieved by an appropriately determining of the configuration of the supporting lobe 9 relative to the part of the brake arm 2 which carries the brake spur 3.

The described ski brakes are very simple, and consist only of the brake arms 2, the spring elements 18, and the guide cams 10. The guide cams can also have a shape different from that of FIG. 1 and can, for example, consist of individual trunnions. In such an arrangement, the guide cams 10 formed by the trunnions would also lie between the brake arms 2 and the spring elements 17 connected to the brake arms 2.

The described ski brakes can also be arranged at a different location of the ski than as is shown in FIG. 1. The brake arms 2 need only be correspondingly adapted.

The described brake has the advantage that the supporting bows 8 are reliably supported in the support lobes 9 and can nevertheless permit a sideways displacement of the brake arms 2, when they are swung from the brake position of FIG. 1 into the skiing position of FIG. 2. Together with a displacement of the brake spur 3 relative to the mid-portion 5 of the brake arm 2, and by the guiding of the brake arms in the detents 30, there is achieved that in the skiing position the brake spurs 3 lies far beyond a position of possible contact with the snow surface.

I claim:

1. A ski brake actuated by a ski boot for a ski having a safety binding, comprising two guide cams each having a bearing portion at a lower end thereof and a contact surface adjacent to and above said bearing portion;

support means for mounting said guide cams over and beyond longitudinal edges of a ski;

two brake arms connected at upper ends thereof by a step rod and having brake spurs at lower ends thereof, said brake arms having contact portions and recesses immovably fixed on said brake arms, said recesses being adjacent and below said contact portions, said bearing portions being received in said recesses to mount pivotally said brake arms on said guide cams for movement between a skiing position in which said brake arms are generally parallel to the longitudinal edges of the ski and said arm contact portions are spaced from said contact surfaces and a braking position in which said brake arms are at an acute angle relative to the longitudinal edges of the ski and said arm contact portions engage said contact surfaces to stop pivoting movement of said brake arms; and spring means for biasing said brake arms toward said braking position.

2. A ski brake according to claim 1, wherein each said guide cam is interposed between the respective brake arm and spring means.

3. A ski brake according to claim 2, wherein each said spring means comprises a spiral spring passing partly around one of said guide cams and having each end thereof coupled to the respective brake arm.

4. A ski brake according to claim 1, wherein each said support means comprises a base plate to be fixed on an upper surface of a ski and a stop depending from each said base plate for engaging a longitudinal edge of a ski to locate the respective guide cam relative to the longitudinal edge.

5. A ski brake according to claim 4, wherein said base plates are laterally offset from said guide cams.

6. A ski brake according to claim 1, wherein said bearing portions are rounded lobes.

7. A ski brake according to claim 6, wherein said recesses are supporting bows formed in and as unitary portions of said brake arms.

8. A ski brake according to claim 1, wherein said recesses are supporting bows formed in and as unitary portions of said brake arms.

9. A ski brake according to claim 1, wherein each said spring means comprises a spring having one end coupled to the respective brake arm and another end coupled to respective support means.

10. A ski brake according to claim 9, wherein said guide cams are elongated and have upper surfaces which are rounded; and said springs are supported on said upper surfaces of said guide cams.

11. A ski brake according to claim 1, wherein said support means are fixed to an upper surface of a ski having longitudinal edges, and said brake arms are above said upper surface and between said longitudinal edges in said skiing position.

12. A ski brake according to claim 11, wherein said support means have detents adjacent and above said longitudinal edges; and said brake arms are biased toward each other so that said brake arms slide in contact with said detents in moving toward said skiing position.

13. A ski brake according to claim 12, wherein said brake arms and said step rod are integral to bias inherently said brake arms toward each other.

14. A ski brake according to claim 12, wherein each of said detents extends gradually upwardly and inwardly from one of said longitudinal edges of said ski.

15. A ski brake according to claim 1, wherein said support means are fixed to an upper surface of a ski; and in said skiing position said brake spurs are spaced a distance above said upper surface greater than the spacing between the remaining portions of said brake arms and said upper surface.

16. A ski brake according to claim 1, wherein said contact surfaces of said guide cams are generally planar.

17. A ski brake according to claim 1, wherein said contact portions of said brake arms have generally planar surfaces facing said guide cams.

18. A ski brake according to claim 17, wherein said contact surfaces of said guide cams are generally planar.

* * * * *